US009568019B2

(12) United States Patent
Lu et al.

(10) Patent No.: US 9,568,019 B2
(45) Date of Patent: Feb. 14, 2017

(54) FAN DEVICE

(71) Applicant: DELTA ELECTRONICS, INC., Kuei San (TW)

(72) Inventors: Chao-Wen Lu, Kuei San (TW); Chun-Chih Wang, Kuei San (TW); Ding-Wei Chiu, Kuei San (TW)

(73) Assignee: DELTA ELECTRONICS, INC. (TW)

( * ) Notice: Subject to any disclaimer, the term of this patent is extended or adjusted under 35 U.S.C. 154(b) by 289 days.

(21) Appl. No.: 14/573,663

(22) Filed: Dec. 17, 2014

(65) Prior Publication Data

US 2015/0337857 A1 Nov. 26, 2015

(30) Foreign Application Priority Data

May 21, 2014 (CN) ..... 2014 1 0215715

(51) Int. Cl.

| | |
|---|---|
| ***F04D 29/42*** | (2006.01) |
| ***F04D 29/52*** | (2006.01) |
| ***F04D 13/06*** | (2006.01) |
| ***F04D 29/60*** | (2006.01) |
| ***F04D 25/06*** | (2006.01) |
| ***F04D 29/44*** | (2006.01) |
| ***F04D 29/62*** | (2006.01) |

(52) U.S. Cl.

CPC ..... *F04D 29/522* (2013.01); *F04D 13/0606* (2013.01); *F04D 25/0613* (2013.01); *F04D 29/4226* (2013.01); *F04D 29/441* (2013.01); *F04D 29/60* (2013.01); *F04D 29/626* (2013.01); *F05D 2260/601* (2013.01)

(58) Field of Classification Search

CPC ..... F04D 29/522; F04D 29/441; F04D 29/40; F04D 29/403; F04D 29/42; F04D 29/4206; F04D 29/4226; F04D 29/62; F04D 29/622; F04D 29/624; F04D 13/0606; F04D 25/0613; F04D 17/16

See application file for complete search history.

(56) References Cited

U.S. PATENT DOCUMENTS

| | | | | |
|---|---|---|---|---|
| 7,672,126 | B2 | 3/2010 | Yeh et al. | |
| 2009/0324403 | A1* | 12/2009 | Zheng | F04D 17/16 415/203 |

FOREIGN PATENT DOCUMENTS

| | | |
|---|---|---|
| CN | 102802380 | 11/2012 |
| TW | 399683 | 7/2000 |

* cited by examiner

*Primary Examiner* — Richard Edgar
(74) *Attorney, Agent, or Firm* — Hauptman Ham, LLP

(57) ABSTRACT

A fan device includes a bottom shell, a cover, and an impeller. The cover includes a main body, a support, and a spoiler. The main body has a through opening. A connection position between the support and the main body has a first folding line. The support is bended along the first folding line to form a portion of the through opening. The support is perpendicular to the main body, and is abutted against the bottom shell. A connection position between the spoiler and the main body has a second folding line. The spoiler is bended along the second folding line to locate in the through opening. An acute angle is formed between the spoiler and the surface of the main body facing away from the bottom shell. The impeller is located in an accommodating space between the cover and the bottom shell.

18 Claims, 7 Drawing Sheets

FAN DEVICE

RELATED APPLICATIONS

This application claims priority to China Application Serial Number 201410215715.9, filed May 21, 2014, which is herein incorporated by reference.

BACKGROUND

Field of Invention

The present invention relates to a fan device.

Description of Related Art

A conventional fan device used in a laptop computer includes a housing and blades. The blades are disposed in the housing. When a motor drives the blades, heat can be dissipated from the interior of the laptop computer.

The size of the fan device is limited by the inner space of the laptop computer, so that the thickness of the housing is usually thin and influences the anti-pressure strength of the housing. For example, the housing includes a cover and a base. When the cover is pressed by an external force, the cover with insufficient strength can be interfered with the blades. In order to solve the interference between the cover and the blades, the manufactures of the fan device often adopt the following methods:

First of all, the thickness of the cover is increased. However, increasing the thickness of the cover increases the volume of the fan device, and thus the fan device cannot be installed in a limited space if required. Again, the thickness of the cover can be increased by decreasing the height of the blades. In this method, although the volume of the fan device is the same, the blowing rate (working area) of the fan device is reduced.

Secondly, an additional concave-convex structure is disposed on the cover. When the concave-convex structure is disposed on the cover, the concave-convex structure increases the air resistance of the fan device and decreases the blowing rate of the fan device, and thus the heat dissipation rate of the fan device is reduced.

Furthermore, a support pillar is disposed between the cover and the base. The support pillar between the cover and the base is formed on a metal base by plastic injection molding. The support pillar has a certain volume, and the airflow is likely to be blocked by the support pillar, thus decreasing the blowing rate of the fan device. As a result, the heat dissipation efficiency of the fan device is reduced.

SUMMARY

An aspect of the present invention is to provide a fan device.

According to an embodiment of the present invention, a fan device includes a bottom shell, a cover, and an impeller. The cover is located on the bottom shell. An accommodating space is formed between the cover and the bottom shell. The cover includes a main body, a support, and a spoiler. The main body has a through opening. A connection position between the support and the main body has a first folding line. The support is bended along the first folding line to form a portion of the through opening. The support is perpendicular to the main body. The support is abutted against the bottom shell. A connection position between the spoiler and the main body has a second folding line. The spoiler is bended along the second folding line to locate in the through opening. An acute angle is included between the spoiler and the surface of the main body facing away from the bottom shell. The impeller is located in the accommodating space.

In one embodiment of the present invention, the acute angle is smaller than or equal to 45 degrees.

In one embodiment of the present invention, the impeller is used to form airflow, and a lengthwise direction of the spoiler is substantially perpendicular to a direction of the airflow.

In one embodiment of the present invention, an air outlet is formed between the cover and the bottom shell, and a length of the through opening is in a range from 1.05 to 2.5 times of a height of the air outlet.

In one embodiment of the present invention, an end of the support facing away from the main body has a contact portion, and the contact portion is parallel to the bottom shell and abutted against the bottom shell.

In one embodiment of the present invention, a shape of the support is an arc shape.

In one embodiment of the present invention, a shape of the spoiler is an arc shape.

In one embodiment of the present invention, the spoiler has a first sub-plate and a second sub-plate. The first sub-plate is adjacent to the main body. The second sub-plate is adjacent to an edge of the first sub-plate facing away from the main body. An obtuse angle is formed between the first and second sub-plates.

In one embodiment of the present invention, a height of the support is greater than a thickness of the impeller.

In the aforementioned embodiments of the present invention, the main body, the support, and the spoiler of the cover are integrally formed as a single piece. The support can be bended along the first folding line to abut against the bottom shell. Therefore, when the cover is pressed by an external force, the support can provide supporting strength to the cover, and avoid forming the interference between the cover and the impeller. Moreover, since the support is formed by bending the main body of the cover, the thickness of the support is thin or substantially equal to the thickness of the plate material of the cover, and the airflow will not be easily blocked by the support, thus the heat dissipation efficiency is not affected. In addition, when the impeller rotates, the airflow in the accommodating space passes under the through opening. Since the spoiler is bended to be obliquely located in the through opening along the second folding line, the airflow is prevented from flowing out of the through opening, and the airflow in the through opening can further draw the air outside the fan device into the through opening. As a result, the blowing rate of the fan device can be increased, and the airflow distribution of the air outlet can be significantly uniform.

Another aspect of the present invention is to provide a fan device.

According to an embodiment of the present invention, a fan device includes a bottom shell, a cover, and an impeller. The cover is located on the bottom shell. An accommodating space is formed between the cover and the bottom shell. The cover includes a main body, a support, and a spoiler. The main body has a through opening. A connection position between the support and the main body has a folding line. The support is bended along the folding line to form the through opening. The support is perpendicular to the main body. The support is abutted against the bottom shell. The spoiler is located at a side of the through opening adjacent to the support. The spoiler protrudes from the main body toward the bottom shell. An acute angle is formed between the spoiler and the surface of the main body facing away from the bottom shell. The impeller is located in the accommodating space.

In the aforementioned embodiments of the present invention, the main body, the support, and the spoiler of the cover are integrally formed as a single piece. The support can be bended along the folding line to abut against the bottom shell. Therefore, when the cover is pressed by an external force, the support can provide supporting strength to the cover, and avoid forming the interference between the cover and the impeller. Moreover, since the support is formed by bending the main body of the cover, the thickness of the support is thin or substantially equal to the thickness of the plate material of the cover, and the airflow will not be easily blocked by the support, thus the heat dissipation efficiency is not affected. In addition, when the impeller rotates, the airflow in the accommodating space passes under the through opening. Since the spoiler is obliquely located at a side of the through opening adjacent to the support, the airflow is prevented from flowing out of the through opening, and the airflow in the through opening can further draw the air outside of the fan device into the through opening. As a result, the blowing rate of the fan device can be increased, and the airflow distribution of the air outlet can be significantly uniform.

It is to be understood that both the foregoing general description and the following detailed description are by examples, and are intended to provide further explanation of the invention as claimed.

BRIEF DESCRIPTION OF THE DRAWINGS

The invention can be more fully understood by reading the following detailed description of the embodiments, with reference made to the accompanying drawings as follows.

DETAILED DESCRIPTION

Figure 1:
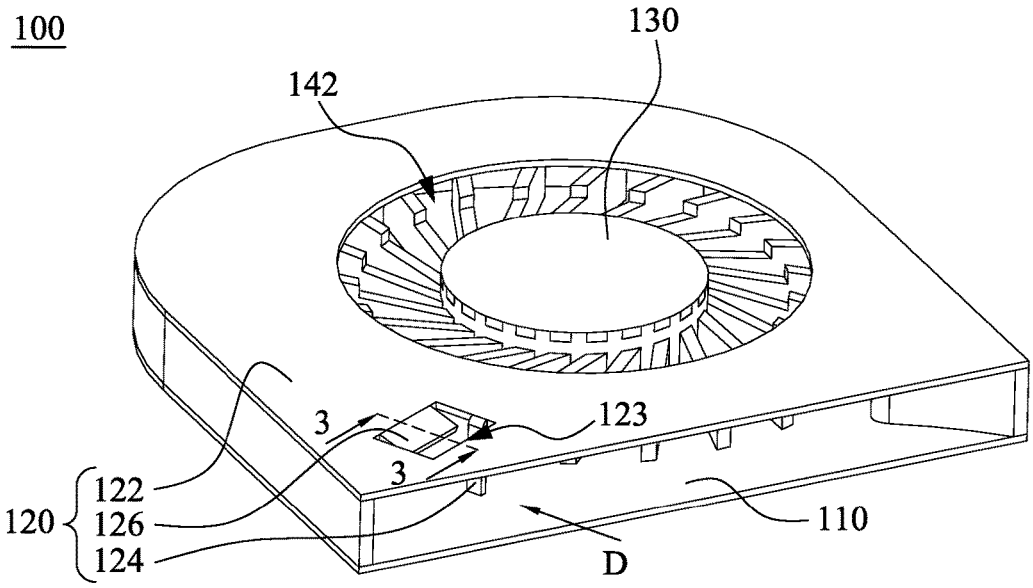
FIG. 1 is a perspective view of a fan device according to one embodiment of the present invention.

Reference will now be made in detail to the present embodiments of the invention, examples of which are illustrated in the accompanying drawings. Wherever possible, the same reference numbers are used in the drawings and the description to refer to the same or like parts.

FIG. 1 is a perspective view of a fan device 100 according to one embodiment of the present invention. The fan device 100 includes a bottom shell 110, a cover 120, and an impeller 130. The cover 120 is located on the bottom shell 110, and an accommodating space 142 is formed between the cover 120 and the bottom shell 110. The impeller 130 is located in the accommodating space 142, and can be driven to rotate by a motor. The cover 120 includes a main body 122, a support 124, and a spoiler 126. The main body 122 has a through opening 123. The main body 122, the support 124, and the spoiler 126 are integrally formed as a single piece.

When the support 124 and the spoiler 126 are manufactured, a stamping process can be performed on the cover 120, such that the original plate material of the cover 120 in the through opening 123 becomes two plate bodies. Only a single edge of each of the two plate bodies is connected to the main body 122. Thereafter, the two plate bodies are bended out from the main body 122, thus forming the support 124 and the spoiler 126.

Figure 2:
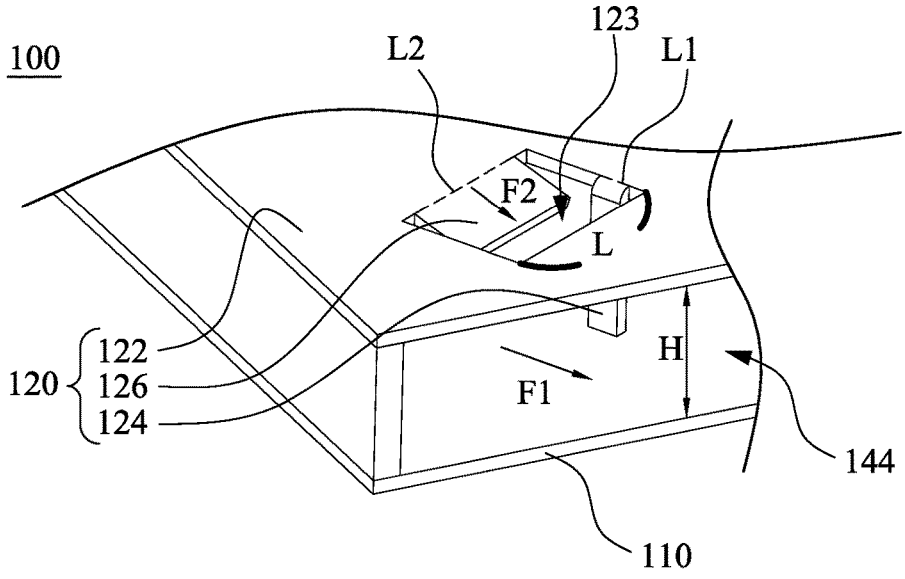
FIG. 2 is a partially enlarged view of the fan device shown in FIG. 1.

FIG. 2 is a partially enlarged view of the fan device 100 shown in FIG. 1. As shown in FIGS. 1 and 2, a connection position between the support 124 and the main body 122 has a first folding line L1. The support 124 is bended along the first folding line L1 to form a portion of the through opening 123. The support 124 is perpendicular to the main body 122, and is abutted against the bottom shell 110. As a result, when the cover 120 is pressed by an external force, the support 124 can provide supporting strength to the cover 120. The support 124 prevents the cover 120 from being deformed by compression, such that the support 124 does not contact the impeller 130 to avoid forming the interference between the cover 120 and the impeller 130. Moreover, the support 124 is formed by bending the main body 122 of the cover 120, so that the thickness of the support 124 is thin, and is substantially equal to the thickness of the plate material of the cover 120. When the impeller 130 rotates to form airflow F1, the airflow F1 will not be easily blocked by the support 124, thus the heat dissipation efficiency of the fan device 100 is not affected.

In this embodiment, the bottom shell 110 and the cover 120 can be made of a material including metal. Therefore, when the support 124 is in contact with the bottom shell 110, the support 124 and the bottom shell 110 will not be easily damaged by abrasion, and the operation life of the bottom shell 110 and the cover 120 can be extended.

Figure 3:
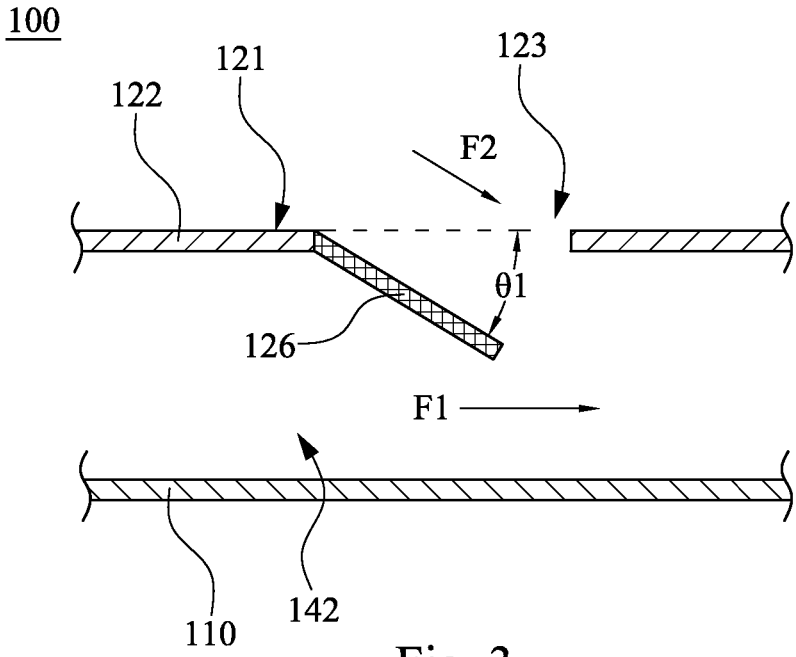
FIG. 3 is a cross-sectional view of a cover and a bottom shell taken along line 3-3 shown in FIG. 1.

FIG. 3 is a cross-sectional view of the cover 120 and the bottom shell 110 taken along line 3-3 shown in FIG. 1. As shown in FIGS. 2 and 3, a connection position between the spoiler 126 and the main body 122 has a second folding line L2. The spoiler 126 can be bended along the second folding line L2 so as to be positioned in the through opening 123. An acute angle θ1 is formed between the spoiler 126 and the surface 121 of the main body 22 facing away from the bottom shell 110, and the acute angle θ1 is smaller than or equal to 45 degrees. The impeller 130 (see FIG. 1) can form the airflow F1, and a lengthwise direction of the spoiler 126

(i.e., the direction of the second folding line L2) is substantially perpendicular to the direction of the airflow F1. "Substantially" used herein means that there can be differences as a result of manufacturing errors. Moreover, an air outlet 144 communicating with the accommodating space 142 is formed between the cover 120 and the bottom shell 110. In this embodiment, the length L of the through opening 123 is in a range from 1.05 to 2.5 times as much as the height H of the air outlet 144.

When the impeller 130 (see FIG. 1) rotates, the airflow F1 in the accommodating space 142 passes under the through opening 123. Since the spoiler 126 is bended to be obliquely located in the through opening 123 along the second folding line L2, the airflow F1 is prevented from flowing out of the through opening 123, and the airflow F1 in the through opening 123 can further draw the air outside of the fan device 100 into the through opening 123 (i.e., airflow F2). As a result, the blowing rate of the fan device 100 can be increased, and the airflow distribution of the air outlet 144 can be significantly uniform.

Figure 4:
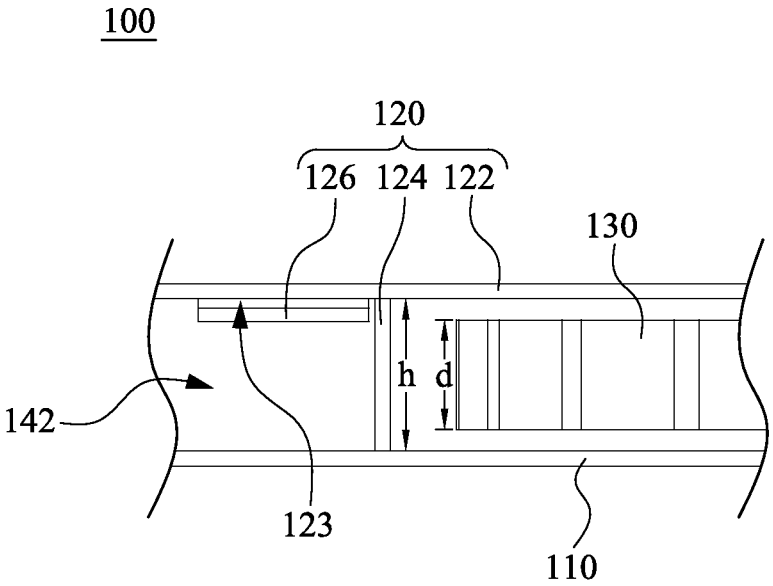
FIG. 4 is side view of the fan device show in FIG. 1, in which the side view is viewed in a direction D.

FIG. 4 is side view of the fan device 100 show in FIG. 1, in which the side view is viewed in a direction D. As shown in FIG. 4, a height h of the support 124 is greater than a thickness d of the impeller 130. The support 124 supports the main body 122. When the cover 120 is pressed, the support 124 can prevent the cover 120 from contacting the impeller 130.

It is to be noted that the connection relationships of the elements described above will not be stated again in the following description, and aspects related to other types of the fan device will be described in the following description.

Figure 5:
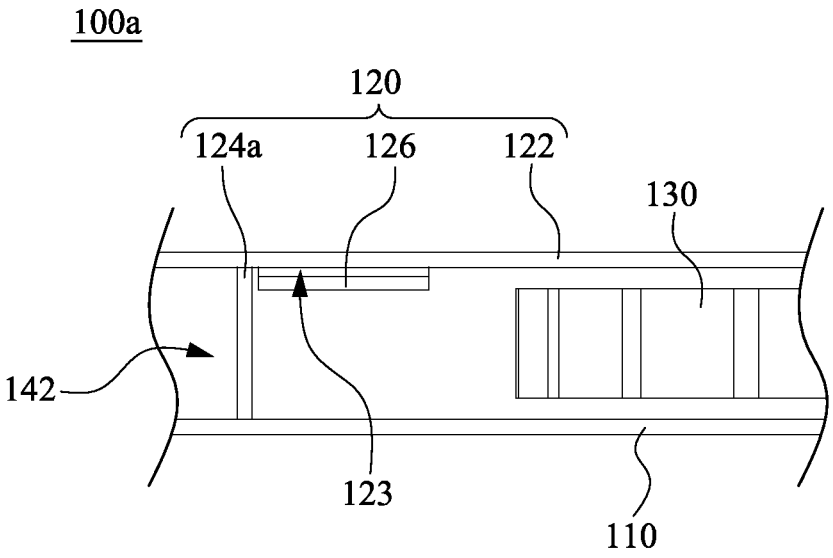
FIG. 5 is a side view of a fan device according to another embodiment of the present invention.

FIG. 5 is a side view of a fan device 100*a* according to another embodiment of the present invention. The fan device 100*a* includes the bottom shell 110, the cover 120, and the impeller 130. The cover 120 includes the main body 122, a support 124*a*, and the spoiler 126. The difference between this embodiment and the embodiment shown in FIG. 4 is that the support 124*a* is mirror reflectively disposed to the support 124 shown in FIG. 4. The support 124 is connected to the right side of the main body 122 adjacent to the through opening 123, and the support 124*a* is connected to the left side of the main body 122 adjacent to the through opening 123.

Figure 6:
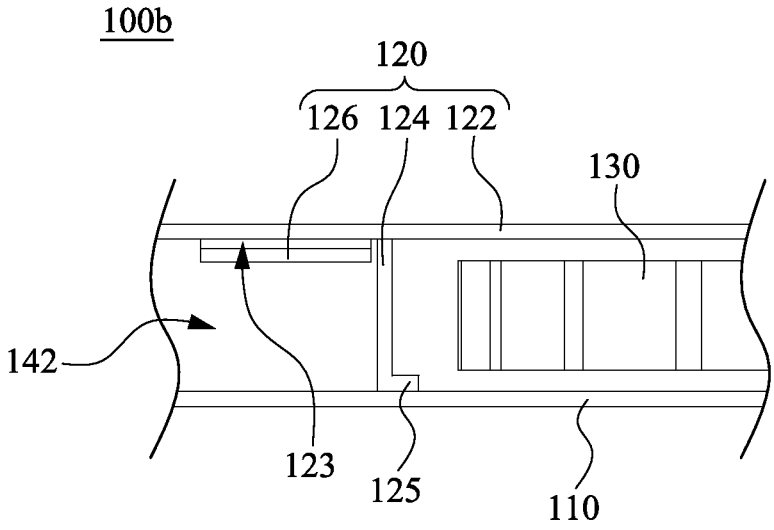
FIG. 6 is a side view of a fan device according to another embodiment of the present invention.

FIG. 6 is a side view of a fan device 100*b* according to another embodiment of the present invention. The fan device 100*b* includes the bottom shell 110, the cover 120, and the impeller 130. The cover 120 includes the main body 122, the support 124, and the spoiler 126. The difference between this embodiment and the embodiment shown in FIG. 4 is that an end of the support 124 facing away from the main body 122 has a contact portion 125. The contact portion 125 is parallel to the bottom shell 110 and abutted against the bottom shell 110. As a result, when the cover 120 is pressed by an external force, the contact portion 125 can ensure the support 124 to be perpendicular to the bottom shell 110 and the main body 122 without shifting, so as to provide supporting strength to the cover 120.

Figure 7:
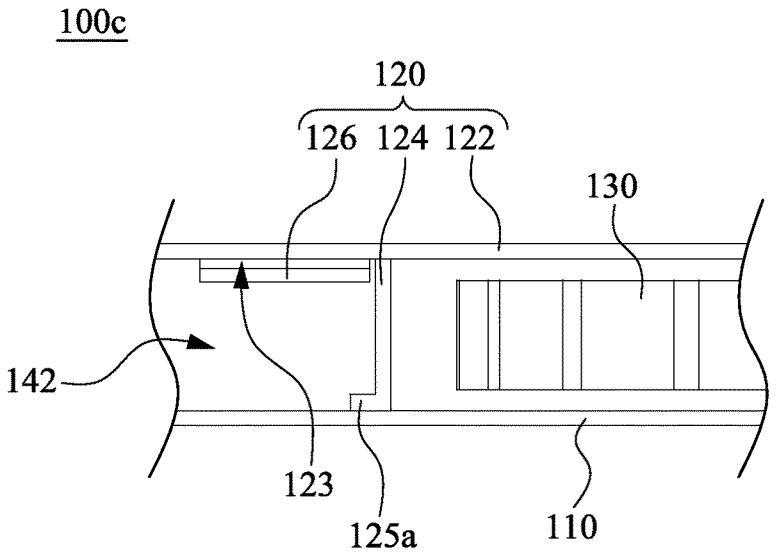
FIG. 7 is a side view of a fan device according to another embodiment of the present invention.

FIG. 7 is a side view of a fan device 100*c* according to another embodiment of the present invention. The fan device 100*c* includes the bottom shell 110, the cover 120, and the impeller 130. The cover 120 includes the main body 122, the support 124, and the spoiler 126. The difference between this embodiment and the embodiment shown in FIG. 6 is that an end of the support 124 facing away from the main body 122 has a contact portion 125*a*. The extending direction of the contact portion 125*a* from the support 124 is opposite to the extending direction of the contact portion 125 from the support 124 shown in FIG. 6.

Figure 8:
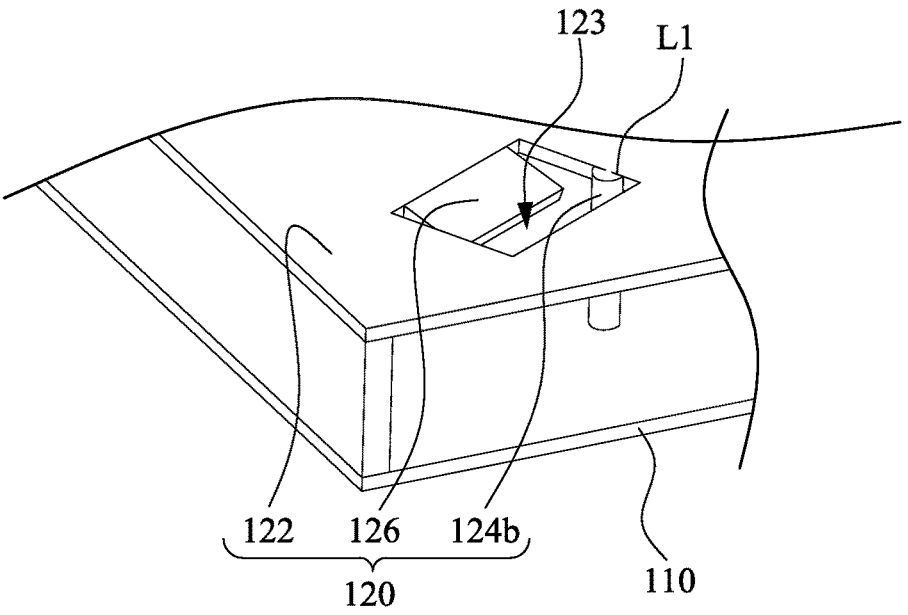
FIG. 8 is a partially enlarged view of a fan device according to one embodiment of the present invention.

FIG. 8 is a partially enlarged view of a fan device 100*d* according to one embodiment of the present invention. The fan device 100*d* includes the bottom shell 110, the cover 120, and the impeller 130 (see FIG. 1). The cover 120 includes the main body 122, the support 124*b*, and the spoiler 126. The difference between this embodiment and the embodiment shown in FIG. 2 is that a shape of the support 124*b* is an arc shape. When the cover 120 is pressed by an external force, the arc-shaped support 124*b* will not easily shift on the bottom shell 110, and the arc-shaped design ensures the support 124*b* to be perpendicular to the bottom shell 110 and the main body 122, so as to provide supporting strength for the cover 120.

Figure 9:
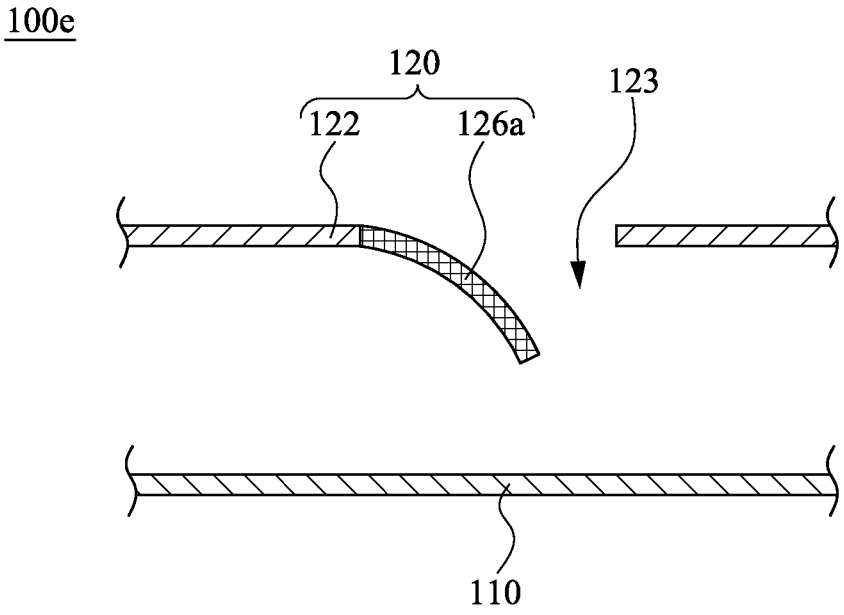
FIG. 9 is a cross-sectional view of a cover and a bottom shell according to another embodiment of the present invention, in which a position of a cut line is the same that of FIG. 3.

FIG. 9 is a cross-sectional view of a cover 120 and a bottom shell 110 according to another embodiment of the present invention, in which a position of a cut line is the same that of FIG. 3. The fan device 100*e* includes the bottom shell 110, the cover 120, and the impeller 130 (see FIG. 1). The difference between this embodiment and the embodiment shown in FIG. 3 is that the shape of the spoiler 126*a* of the cover 120 is an arc shape. In this embodiment, the concave surface of the spoiler 126*a* faces the bottom shell 110, but the present invention is not limited in this regard.

Figure 10:
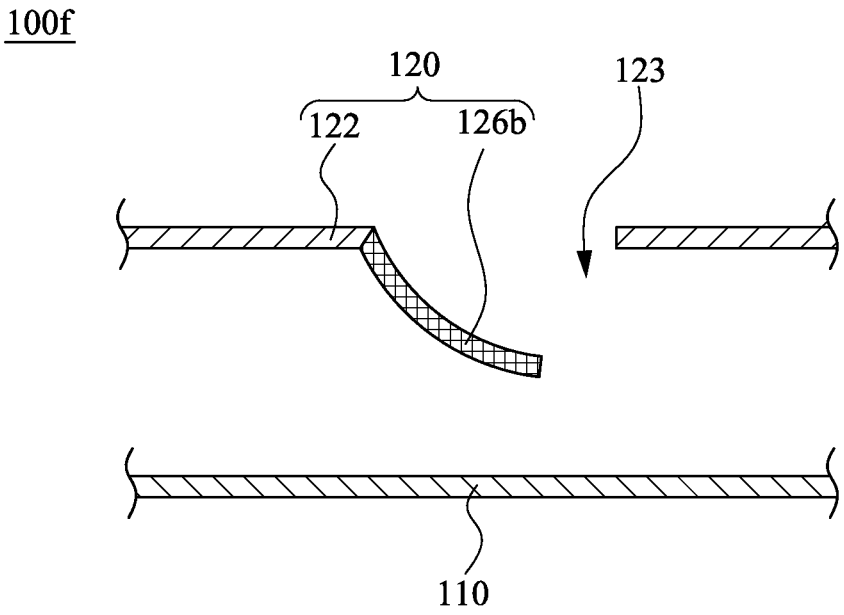
FIG. 10 is a cross-sectional view of a cover and a bottom shell according to another embodiment of the present invention, in which a position of a cut line is the same that of FIG. 3.

FIG. 10 is a cross-sectional view of a cover 120 and a bottom shell 110 according to another embodiment of the present invention, in which a position of a cut line is the same that of FIG. 3. The fan device 100*f* includes the bottom shell 110, the cover 120, and the impeller 130 (see FIG. 1). The difference between this embodiment and the embodiment shown in FIG. 9 is that the protruding surface of the spoiler 126*b* of the cover 120 faces the bottom shell 110.

Figure 11:
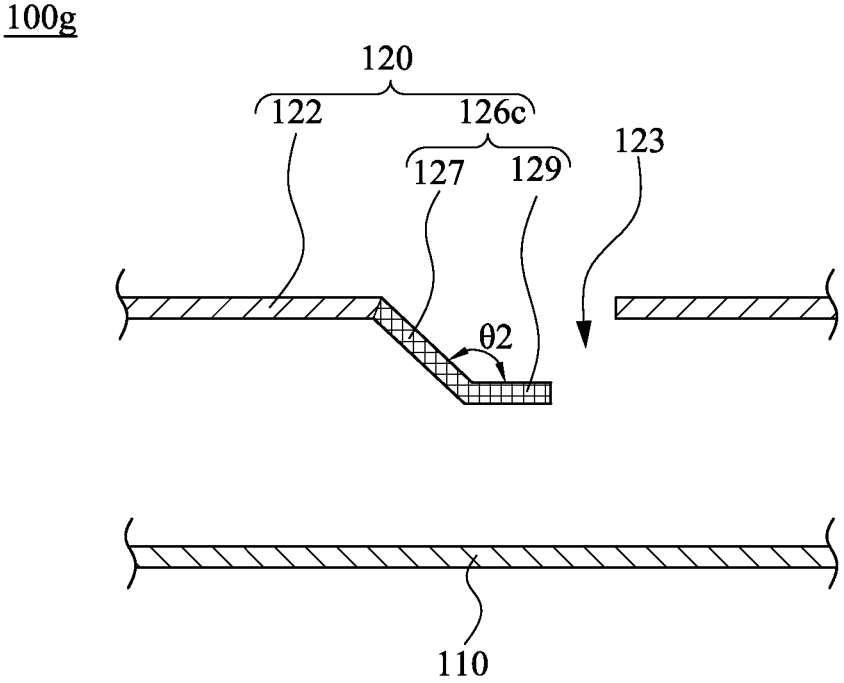
FIG. 11 is a cross-sectional view of a cover and a bottom shell according to another embodiment of the present invention, in which a position of a cut line is the same that of FIG. 3.

FIG. 11 is a cross-sectional view of a cover 120 and a bottom shell 110 according to another embodiment of the present invention, in which a position of a cut line is the same that of FIG. 3. The fan device 100*g* includes the bottom shell 110, the cover 120, and the impeller 130 (see FIG. 1). The difference between this embodiment and the embodiment shown in FIG. 3 is that a spoiler 126*c* has a first sub-plate 127 and a second sub-plate 129. The first sub-plate 127 is adjacent to the main body 122. The second sub-plate 129 is adjacent to an edge of the first sub-plate 127 facing away from the main body 122. An obtuse angle θ2 is formed between the first and second sub-plates 127, 129.

Figure 12:
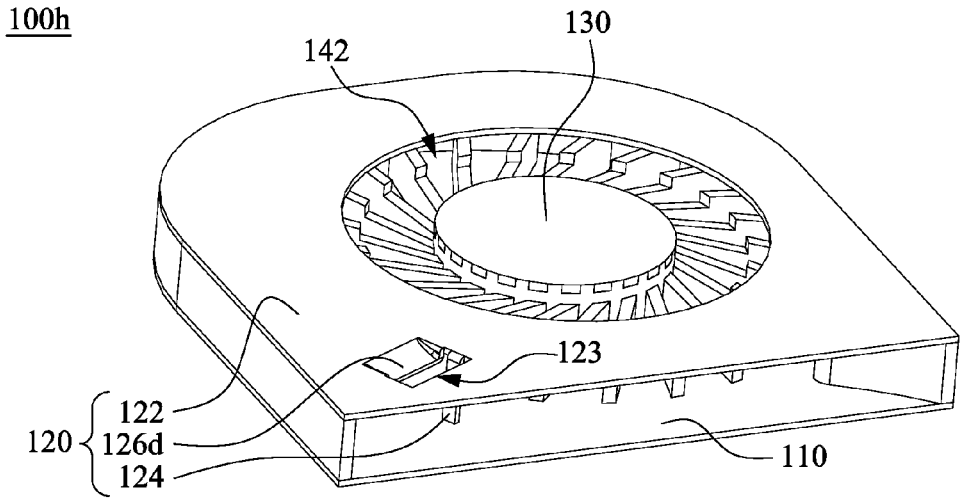
FIG. 12 is a perspective view of a fan device according to one embodiment of the present invention.
Figure 13:
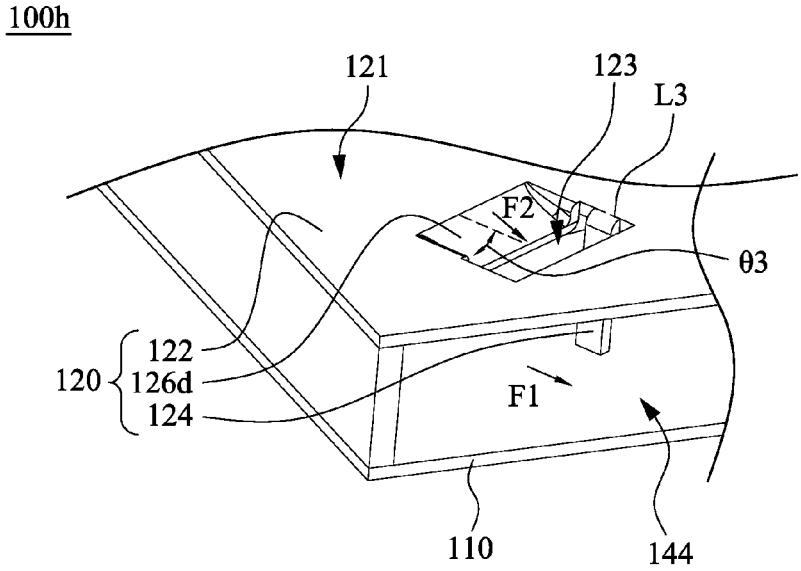
FIG. 13 is a partially enlarged view of the fan device show in FIG. 12.

FIG. 12 is a perspective view of a fan device 100*h* according to one embodiment of the present invention. FIG. 13 is a partially enlarged view of the fan device 100*h* show in FIG. 12. As shown in FIGS. 12 and 13, the fan device 100*h* includes a bottom shell 110, a cover 120, and an impeller 130. The cover 120 is located on the bottom shell 110. An accommodating space 142 is formed between the cover 120 and the bottom shell 110, and the impeller 130 is located in the accommodating space 142. The cover 120 includes a main body 122, a support 124, and a spoiler 126*d*. The main body 122 has a through opening 123. The main body 122, the support 124, and the spoiler 126*d* are integrally formed as a single piece.

When the support 124 and the spoiler 126*d* are manufactured, a stamping process can be performed on the cover 120, such that the original plate material of the cover 120 in the through opening 123 is formed as a single plate body. Only a single edge of the plate body is connected to the main body 122. Thereafter, the plate body is bended out from the main body 122 to form the support 124. Moreover, the plate material of the cover 120 adjacent to the through opening

123 can also form a concave portion during the stamping process, so as to form the spoiler 126*d*.

A connection position between the support 124 and the main body 122 has a folding line L3. The support 124 can be bended along the folding line L3 to form the through opening 123. The support 124 is perpendicular to the main body 122, and the support 124 is abutted against the bottom shell 110. The spoiler 126*d* is located at a side of the through opening 123 adjacent to the support 124. In this embodiment, the spoiler 126*d* protrudes from the main body 110 toward the bottom shell 110. An acute angle θ3 is formed between the spoiler 126*d* and the surface 121 of the main body 122 facing away from the bottom shell 110.

The support 124 can be bended along the folding line L3 to abut against the bottom shell 110. Therefore, when the cover 120 is pressed by an external force, the support 124 can provide supporting strength to the cover 120, and avoid forming the interference between the cover 120 and the impeller 130. Moreover, since the support 124 is formed by bending the main body 122 of the cover 120, the thickness of the support 124 is thin (substantially equal to the thickness of the plate material of the cover 120), and the airflow F1 will not easily be blocked by the support 124, thus the heat dissipation efficiency is not affected. In addition, when the impeller 130 rotates, the airflow F1 in the accommodating space 142 passes under the through opening 123. Since the spoiler 126*d* is obliquely located at a side of the through opening 123 adjacent to the support 124, the airflow F1 is prevented from flowing out of the through opening 123, and the airflow F1 in the through opening 123 can further draw the air outside of the fan device 100*h* into the through opening 123 (i.e., airflow F2). As a result, the blowing rate of the fan device 100*h* can be increased, and the airflow distribution of the air outlet 144 can be significantly uniform.

Other features of the fan device 100*h* can be similar to the fan device 100 shown in FIGS. 1 to 4, and will not be described again. Moreover, in other embodiments, the support 124 can be selectively similar to one of the supports shown in FIGS. 5 to 8, and the cross-sectional shape of the spoiler 126*d* can be selectively similar to one of the spoilers shown in FIGS. 9 to 11. The support 124 and the spoiler 126*d* can be varied as deemed necessary by designers, and the present invention is not limited in this regard.

Although the present invention has been described in considerable detail with reference to certain embodiments thereof, other embodiments are possible. Therefore, the spirit and scope of the appended claims should not be limited to the description of the embodiments contained herein.

It will be apparent to those skilled in the art that various modifications and variations can be made to the structure of the present invention without departing from the scope or spirit of the invention. In view of the foregoing, it is intended that the present invention cover modifications and variations of this invention provided they fall within the scope of the following claims.

What is claimed is:

1. A fan device comprising:

a bottom shell;

a cover located on the bottom shell, wherein an accommodating space is formed between the cover and the bottom shell, and the cover comprises:

a main body having a through opening;

a support, wherein a connection position between the support and the main body has a folding line, the support is bended along the folding line to form the through opening, the support is perpendicular to the main body, and the support is abutted against the bottom shell; and a spoiler located at a side of the through opening adjacent to the support, wherein the spoiler protrudes from the main body toward the bottom shell, and an acute angle is formed between the spoiler and a surface of the main body facing away from the bottom shell; and an impeller located in the accommodating space.

2. The fan device of claim 1, wherein the acute angle is smaller than or equal to 45 degrees.

3. The fan device of claim 1, wherein the impeller is operated for forming airflow, and a lengthwise direction of the spoiler is substantially perpendicular to a direction of the airflow.

4. The fan device of claim 1, wherein an air outlet is formed between the cover and the bottom shell, and a length of the through opening is in a range from 1.05 to 2.5 times of a height of the air outlet.

5. The fan device of claim 1, wherein an end of the support facing away from the main body has a contact portion, and the contact portion is parallel to the bottom shell and abutted against the bottom shell.

6. The fan device of claim 1, wherein a shape of the support is an arc shape.

7. The fan device of claim 1, wherein a shape of the spoiler is an arc shape.

8. The fan device of claim 1, wherein the spoiler has a first sub-plate and a second sub-plate, the first sub-plate is adjacent to the main body, the second sub-plate is adjacent to an edge of the first sub-plate facing away from the main body, and an obtuse angle is formed between the first and second sub-plates.

9. The fan device of claim 1, wherein a height of the support is greater than a thickness of the impeller.

10. A fan device comprising:

a bottom shell;

a cover located on the bottom shell, wherein an accommodating space is formed between the cover and the bottom shell, and the cover comprises:

a main body having a through opening;

a support, wherein a connection position between the support and the main body has a first folding line, the support is bended along the first folding line to form a portion of the through opening, the support is perpendicular to the main body, and the support is abutted against the bottom shell; and a spoiler, wherein a connection position between the spoiler and the main body has a second folding line, the spoiler is bended along the second folding line to locate in the through opening, and an acute angle is formed between the spoiler and a surface of the main body facing away from the bottom shell; and an impeller located in the accommodating space.

11. The fan device of claim 10, wherein the acute angle is smaller than or equal to 45 degrees.

12. The fan device of claim 10, wherein the impeller is operated for forming airflow, and a lengthwise direction of the spoiler is substantially perpendicular to a direction of the airflow.

13. The fan device of claim 10, wherein an air outlet is formed between the cover and the bottom shell, and a length of the through opening is in a range from 1.05 to 2.5 times of a height of the air outlet.

14. The fan device of claim 10, wherein an end of the support facing away from the main body has a contact portion, and the contact portion is parallel to the bottom shell and abutted against the bottom shell.

15. The fan device of claim 10, wherein a shape of the support is an arc shape.

16. The fan device of claim 10, wherein a shape of the spoiler is an arc shape.

17. The fan device of claim 10, wherein the spoiler has a first sub-plate and a second sub-plate, the first sub-plate is adjacent to the main body, the second sub-plate is adjacent to an edge of the first sub-plate facing away from the main body, and an obtuse angle is formed between the first and second sub-plates.

18. The fan device of claim 10, wherein a height of the support is greater than a thickness of the impeller.

* * * * *